US007645096B2

(12) United States Patent
Hedrick

(10) Patent No.: US 7,645,096 B2
(45) Date of Patent: Jan. 12, 2010

(54) YIELDING ROCK BOLT

(75) Inventor: Neville Hedrick, Wangara (AU)

(73) Assignee: Garford Pty Ltd, Wangara (AU)

( * ) Notice: Subject to any disclaimer, the term of this patent is extended or adjusted under 35 U.S.C. 154(b) by 0 days.

(21) Appl. No.: 10/539,915

(22) PCT Filed: Dec. 16, 2003

(86) PCT No.: PCT/AU03/01667

§ 371 (c)(1),
(2), (4) Date: Oct. 26, 2005

(87) PCT Pub. No.: WO2004/055327

PCT Pub. Date: Jul. 1, 2004

(65) Prior Publication Data

US 2006/0127189 A1 Jun. 15, 2006

(30) Foreign Application Priority Data

Dec. 16, 2002 (AU) ..... 2002953368

(51) Int. Cl.
*E21B 21/00* (2006.01)

(52) U.S. Cl. ..... 405/259.1; 405/259.5

(58) Field of Classification Search ..... 405/259.1, 405/259.5; 52/155; 411/82, 930, 82.3, 383, 411/384, 5

See application file for complete search history.

(56) References Cited

U.S. PATENT DOCUMENTS

| | | | | |
|---|---|---|---|---|
| 2,398,838 | A * | 4/1946 | Miller et al. | 411/107 |
| 3,750,519 | A * | 8/1973 | Lerich | 411/59 |
| 4,440,526 | A | 4/1984 | Koppers et al. | |
| 4,560,305 | A | 12/1985 | Powondra | |
| 5,636,945 | A * | 6/1997 | Nes | 405/259.1 |
| 5,791,823 | A | 8/1998 | Blakley et al. | |
| 6,390,735 | B1 | 5/2002 | Gaudreau et al. | |
| 2002/0081159 | A1 * | 6/2002 | Xu et al. | 405/259.1 |
| 2004/0136789 | A1 * | 7/2004 | Fergusson | 405/259.5 |
| 2005/0042037 | A1 * | 2/2005 | Maltby | 405/259.4 |
| 2005/0158127 | A1 * | 7/2005 | Fergusson | 405/259.5 |
| 2005/0207851 | A1 * | 9/2005 | Ortlepp | 405/259.1 |

FOREIGN PATENT DOCUMENTS

| | | |
|---|---|---|
| EP | 0 659 976 | 6/1995 |
| GB | 1177882 | 1/1970 |
| GB | 2 141 804 | 1/1985 |

* cited by examiner

*Primary Examiner*—David J Bagnell
*Assistant Examiner*—Sean D Andrish
(74) *Attorney, Agent, or Firm*—Bachman & LaPointe, P.C.

(57) ABSTRACT

A yielding rock bolt having a solid metal shaft with a relatively wide portion and a relatively narrow portion and an anchor member mounted about the shaft. The anchor member has longitudinal bore which is of lesser dimension than the relatively wide portion. The anchor member is mounted about the relatively narrow portion adjacent the wide portion. In use the shaft is extruded through the anchor member to cause the rock to yield as a rock face moves.

14 Claims, 4 Drawing Sheets

YIELDING ROCK BOLT

FIELD OF THE INVENTION

The present invention relates to a yielding rock bolt.

SUMMARY OF THE INVENTION

In accordance with one aspect of the present invention there is provided a yielding rock bolt arranged to be inserted into a hole in a rock surface, characterised by comprising a shaft formed of a solid metal bar, the shaft having a first end and a second end, the shaft having a relatively wide portion adjacent the first end thereof and a relatively narrow portion adjacent the wide portion, an anchor member having a longitudinal bore mounted about the shaft at the relatively narrow portion and adjacent the wide portion, the longitudinal bore having at least a portion of lesser dimension than the relatively wide portion

BRIEF DESCRIPTION OF THE DRAWINGS

The present invention will now be described, by way of example, with reference to the accompanying drawings, in which.

DETAILED DESCRIPTION OF THE DRAWINGS

Figure 2:
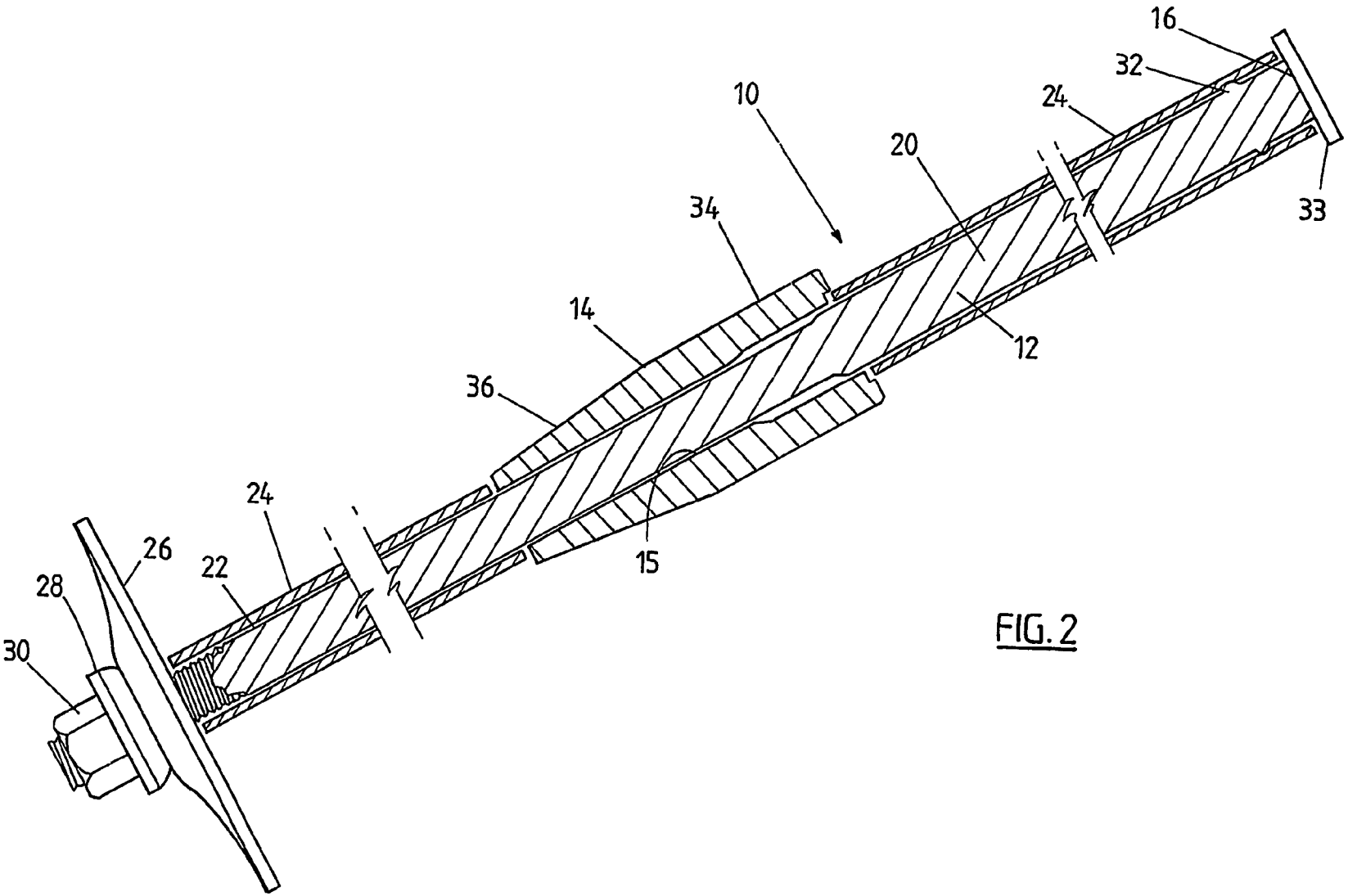
FIG. 2 is a longitudinal cross-sectional view of the rock bolt of FIG. 1.

In the drawings, there is shown a yielding rock bolt 10 comprising a shaft 12 and an anchor member 14 mounted about the shaft 12. The shaft 12 is in the form of a solid metal bar. The anchor member 14 has a longitudinal bore 15 as can be seen in FIG. 2, which receives the shaft 12. The shaft 12 has a first end 16 and a second end 18. Further, the shaft 12 has a relatively wide portion 20 adjacent the first end 16 and a relatively narrow portion 22 adjacent the wide portion 20 and extending to the second end 18. The anchor member 14 is located adjacent the wide portion 20 at the narrow portion 22.

Preferably, the longitudinal bore 15 of the anchor member 14 is dimensioned so that the anchor member 14 can fit over the narrow portion 22 snugly and engage with an inner end of the wide portion 20 as shown in FIG. 2. However, a portion of the longitudinal bore 15 is of lesser dimension than the wide portion 20.

Further, the shaft 12 is provided with a debonding sheath 24 formed of a suitable material such as plastics material extending along and about the full length of the shaft 12 apart from the region at which the anchor member 14 is disposed.

The rock bolt 10 is also provided with a rock-face engaging plate 26 adjacent the second end 18 of the shaft 12. The shaft 12 is formed at the second end 18 with a screw threaded portion.

The plate 26 is fitted over the screw threaded portion of the shaft 12. Then a washer 28 is placed over the second end 18 and a threaded nut 30 is then threadedly engaged with the end 18 to retain the plate 26 and the washer 28 in place.

Further, it is envisaged that the shaft 12 will be provided with a widened stop portion of increased dimension adjacent the first end 16 such as a welded circle 32 formed of relatively hard material inside the sheath 24.

Still further, it is envisaged that a resin mixing paddle 33 may be tack welded to the end 16 of the shaft 12.

Also, the anchor member 14 has a portion 34 which is relatively wide adjacent the wide portion 20 of the shaft 12. Extending towards the second end 18 the anchor member 14 has a portion 36 which tapers inwardly towards the second end 18 of the shaft 12 as can best be seen in FIG. 2.

The anchor member 14 may be manufactured from heat treated steel such as 41/40 steel heat treated to harden it. Further, the bore 15 of the anchor member 14 is nitrided to prevent molecular welding between the anchor member 14 and the shaft 12. Thus, it is particularly important that the anchor member 14 be treated in the longitudinal bore 15 to prevent welding between the anchor member 14 and the shaft 12.

In use, a hole is drilled into a wall of a rock face and the first end 16 of the rock bolt 10 is inserted into the hole until the plate member 26 engages with the rock face around the hole. The anchor member 14 is disposed about the shaft 12 adjacent an inner end of the wide portion 20 remote from the first end 16 of the shaft 12 (as can best be seen in FIG. 2).

The drilled hole around the rock bolt 10 is then filled with a bonding material such as resin, grout or expansion shells in known manner. The anchor member 14 is secured in place by bonding with the bonding material whilst the shaft 12 is capable of sliding longitudinally within the hole relative to the anchor member 14 because of the debonding sheath 24.

If movement of rock causes a portion of the rock face to begin to break away, this portion of the rock face is held in place by the rock bolt 10 being secured at the anchor member 14. However, this movement will cause the wide portion 20 of the shaft 12 to be pulled through the anchor member 14. The rock bolt 10 therefore yields as the rock face moves preventing the possibility of sudden failure of the rock face. In this movement the wide portion 20 of the shaft 12 being of larger dimension than a portion of the longitudinal bore 15 of the anchor member 14 is extruded through the anchor member 14. This provides a predictable and substantially constant force on the anchor member 14.

This force continues until the stop 32 engages with the anchor member 14 at which point the force applied to the anchor member 14 is increased considerably because the stop portion 32 will not extrude through the anchor member 14. At this stage the shaft 12 is subjected to maximum load which is the ultimate tensile strength of the shaft 12.

It is envisaged that the yielding rock bolt 10 of the present invention could be manufactured by a number of techniques. In the embodiment of the present invention illustrated in FIGS. 1 and 2 it is envisaged that the narrow portion 22 could be formed by taking a solid bar of uniform dimension throughout and then extruding a portion of the bar to form the narrow portion 22 extending to the second end 18. In this case, the narrow portion 22 would be relatively long as shown in the accompanying drawings.

In a preferred embodiment of the present invention an anchor member 14 having a relatively wide bore of substantially uniform dimension is disposed about a shaft 12 of substantially uniform dimension throughout its length. The anchor member 14 is then swaged onto the shaft 12 in known manner so as to reduce the dimension of the longitudinal bore and to reduce correspondingly the dimension of the shaft 12 with which the anchor member 14 is engaged. In this embodiment the shaft 12 would only have a narrow portion 22 adjacent the anchor member 14, which narrow portion 22, is a relatively short section of the shaft 12 adjacent the wide portion.

The preferred embodiment of the present invention is illustrated in FIGS. 3 to 6 of the accompanying drawings.

Figure 3:
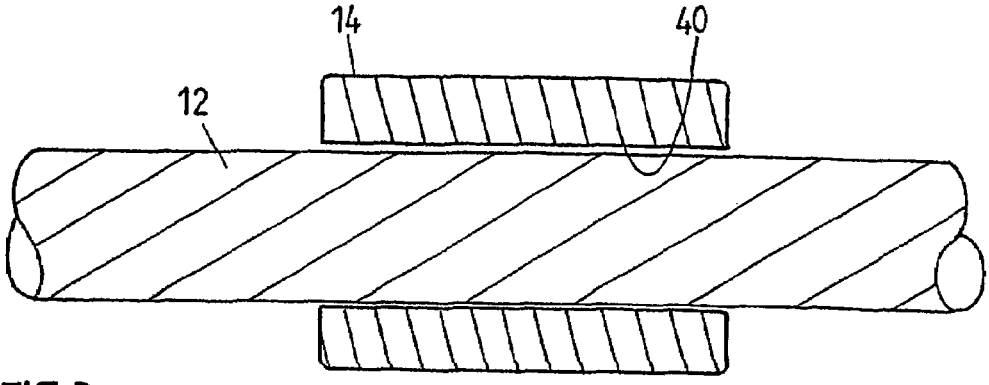
FIG. 3 is a longitudinal cross-sectional view of a shaft having an anchor member mounted thereabout.

In FIG. 3 there is shown in a shaft 12 which is of substantially uniform thickness. Mounted about the shaft 12 is an anchor member 14. In this embodiment, the anchor member 14 is a generally cylindrical member with a longitudinal bore 40. The bore 40 is preferably, as shown, of substantially uniform cross section throughout its length.

Figure 4:
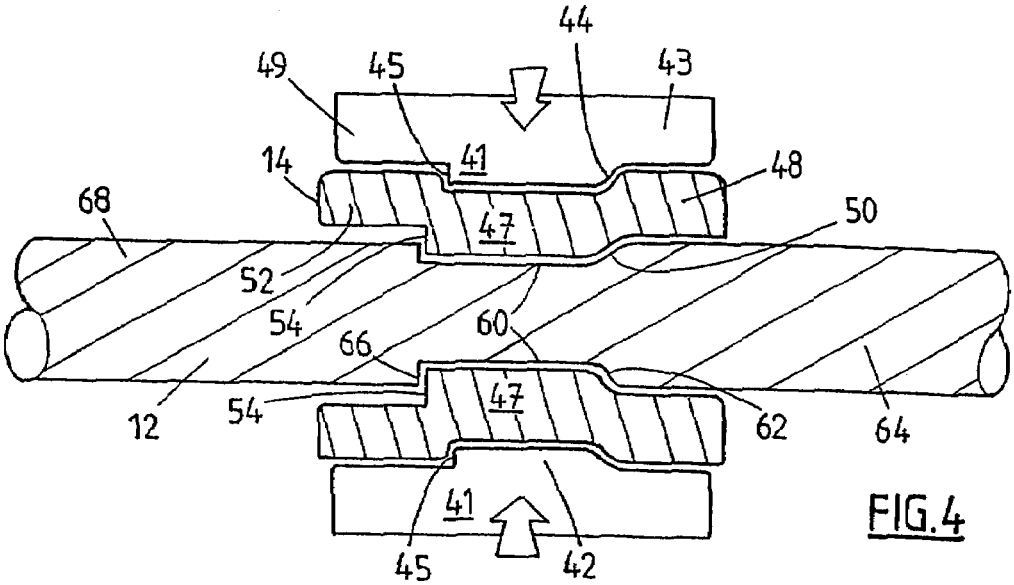
FIG. 4 is a view similar to FIG. 3 showing the anchor member and the shaft being formed into a particular profile by swage press members.

The shaft 12 and the anchor member 14 of FIG. 3 are placed in a swage press which includes a pair of swage press members 41 as seen in FIG. 4. The swage press members 41 are profiled so as to have a relatively deep mid-portion 42. A right hand end portion 43 as seen in FIG. 4 is of less depth. The portions 42 and 43 are interconnected adjacent the shaft 12 by a sloped portion 44.

At the left hand end of the swage press members 41 as seen in FIG. 4, there is a portion 49 connected to the deep mid-portion 42 by a right angle portion 45.

In operation, the swage press members 41 are pressed together in known manner so as to apply deforming force to the anchor member 14 on the shaft 12 as shown in FIG. 4. This causes the anchor member 14 to deform inwardly in a mid-portion 47 thereof in a shape complementary to the swage press members 41.

Figure 5:
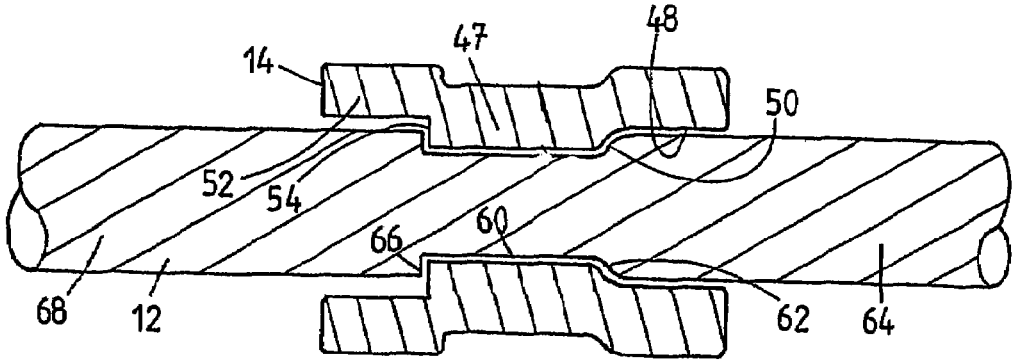
FIG. 5 is a view similar to FIG. 3 showing the shaft and the anchor member after being formed by the swage press members shown in FIG. 4.

The deformation of the anchor member 14 causes a complementary deformation of the shaft 12 to occur. As can be seen in FIG. 5, the bore 40 of the anchor member 14 has an inwardly deformed mid section 47 connected to a non-deformed right hand section 48 by a sloped portion 50. Further, the anchor member has a left hand portion 52 which is non-deformed and is connected to the mid-section 47 by a right angle portion 54.

Further, the shaft 12 has an inwardly deformed portion 60 corresponding in shape to the deformed portion 47 of the anchor member 14. Further, the shaft 12 has a sloped portion 62 connecting the deformed portion 60 to a non-deformed right hand portion 64.

Further, the shaft 12 has a right angle portion 66 connecting the deformed portion 60 to a non-deformed left hand portion 68.

Figure 1:
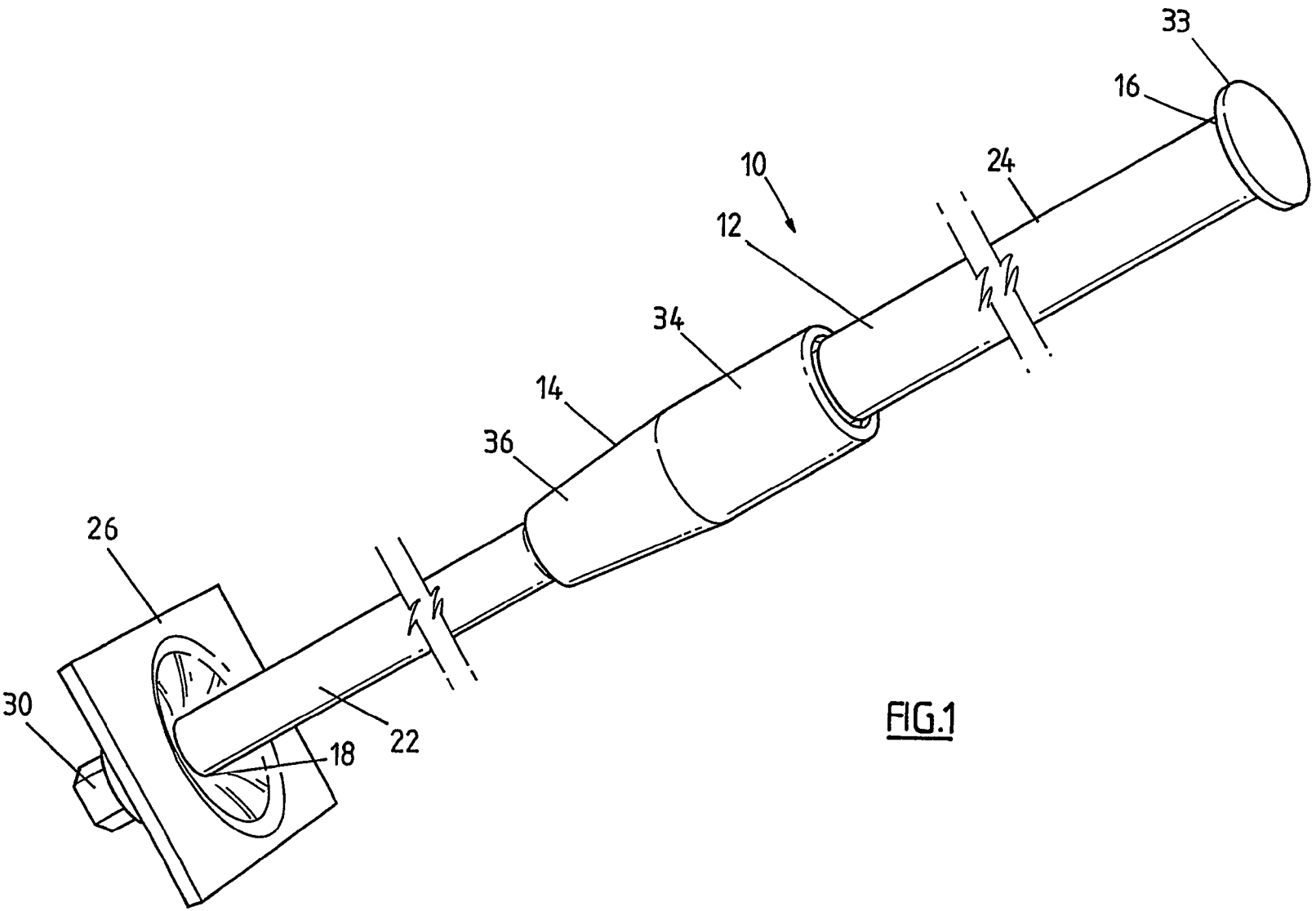
FIG. 1 is a perspective view of a yielding rock bolt in accordance with an embodiment of the present invention.
Figure 6:
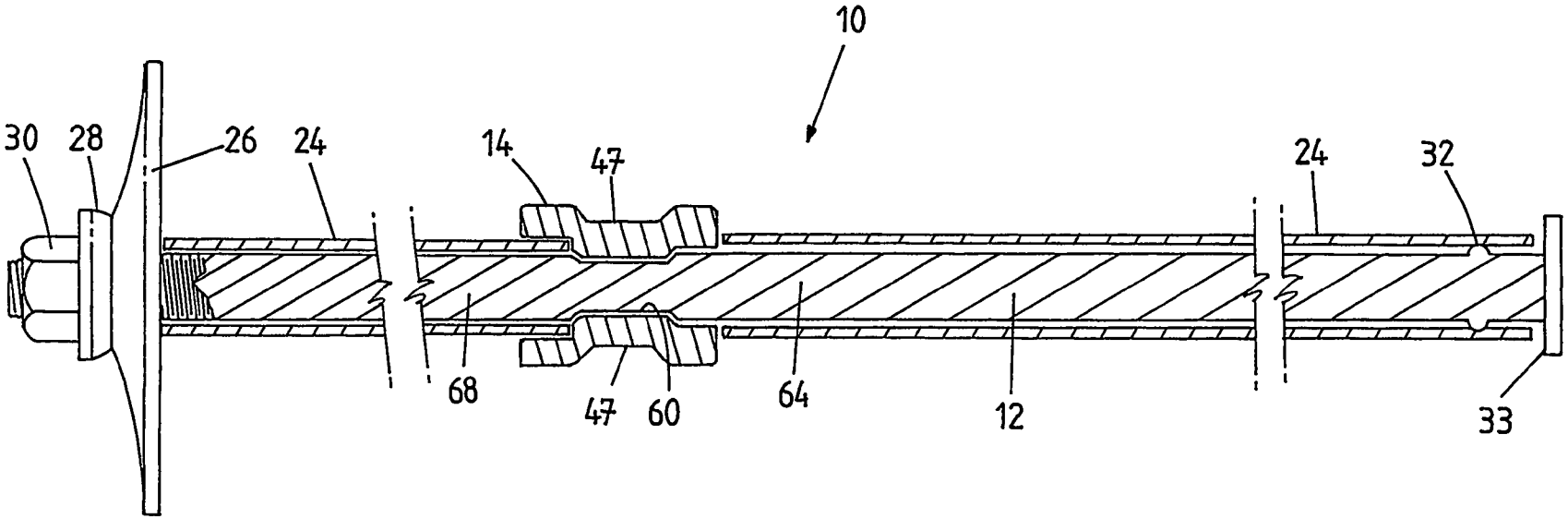
FIG. 6 is a longitudinal cross-sectional view of a rock bolt in accordance with a second embodiment of the present invention formed by the steps illustrated in FIGS. 3 to 5.

As shown in FIG. 6, the yielding rock bolt 10 produced as described above in relation to FIGS. 3 to 5, is fitted up in similar manner to the yielding rock bolt of FIGS. 1 and 2. The rock bolt of FIG. 6 is mounted in a hole in a rock face as described above for FIGS. 1 and 2. Once again, the rock bolt of FIG. 6 holds the rock face in place if a portion of the rock face begins to break away. The movement of the rock face causes the wide portion 64 of the shaft 12 to be pulled through the anchor member 14 with the sloped portion 62 leading.

The anchor member 14 causes deformation of the non-deformed portion 64 of the shaft 12. Thus, the shaft 12 is extruded through the anchor member 14. This produces a predictable and substantially constant force on the anchor member 14.

Modifications and variations as would be apparent to a skilled addressee are deemed to be within the scope of the present invention

The invention claimed is:

1. A yielding rock bolt arranged to be inserted into a hole in a rock surface, comprising a shaft formed of a solid metal bar, the shaft having a first end and a second end, the shaft having respective first and second relatively wide portions adjacent the first end and the second end thereof and a relatively narrow portion intermediate the wide portions, an anchor member having a longitudinal bore mounted about the shaft at the relatively narrow portion and adjacent the relatively wide portions, the longitudinal bore has at least a portion of lesser transverse diameter than that of the relatively wide portions, the anchor member has an internal surface, the relatively narrow portion and immediate adjacent first and second relatively wide portions of the shaft have an external surface, wherein the internal surface and the external surface each has a profile which is complimentary in shape to each other and the anchor member is mounted about the shaft at the relatively narrow portion and the adjacent relatively wide portions thereof.

2. The yielding rock bolt according to claim 1, wherein the narrow portion is substantially U-shaped comprising a base portion and two upstanding side portions wherein one of the side portions forms a substantially right angle with the base and the other side portion forms an obtuse angle with the base.

3. The yielding rock bolt according to claim 1, wherein the narrow portion of the shaft is a relatively short section of the shaft adjacent the wide portions.

4. The yielding rock bolt according to claim 1, wherein the anchor member is formed of heat treated steel.

5. The yielding rock bolt according to claim 4, wherein the anchor member has a relatively wide portion adjacent the wide portion of the shaft and a portion tapering inwardly towards the second end of the shaft.

6. The yielding rock bolt according to claim 4, wherein the longitudinal bore of the anchor member is treated to prevent sticking between the anchor member and the shaft.

7. The yielding rock bolt according to claim 6, wherein the anchor member is nitrided in the longitudinal bore to prevent sticking between the anchor member and the shaft.

8. The yielding rock bolt according to claim 1, wherein a rock engaging plate is mounted about the shaft adjacent the second end thereof.

9. A method of securing a rock face by drilling a hole therein, inserting a yielding rock bolt according to claim 1 into the hole with a first end foremost, filling the hole with bonding material such that if an adjacent portion of the rock face begins to breakaway the wide portion of the shaft is extruded through the anchor member so that the rock bolt yields as the rock face moves.

10. A yielding rock bolt arranged to be inserted into a hole in a rock surface, comprising a shaft formed of a solid metal bar, the shaft having a first end and a second end, the shaft having first and second relatively wide portions adjacent the first end and the second end thereof and a relatively narrow portion intermediate the wide portions, an anchor member having a longitudinal bore mounted about the shaft at the relatively narrow portion and adjacent the wide portions, the longitudinal bore having at least a portion of lesser transverse diameter than that of the relatively wide portions, the anchor member has an internal surface, the narrow portion and immediate adjacent first and second portions of the shaft have an external surface, wherein the internal surface and the external surface each has a profile which is complimentary in shape to each other, wherein a debonding sheath is mounted about the shaft in regions thereof apart from the anchor member.

11. The yielding rock bolt according to claim 10, wherein the debonding sheath extends along a full length of the shaft apart from a region at which the anchor member is disposed.

12. A yielding rock bolt arranged to be inserted into a hole in a rock surface, comprising a shaft formed of a solid metal bar, the shaft having a first end and a second end, the shaft having first and second relatively wide portions adjacent the first end and the second end thereof and a relatively narrow portion intermediate the wide portions, an anchor member having a longitudinal bore mounted about the shaft at the relatively narrow portion and adjacent the wide portions, the longitudinal bore having at least a portion of lesser transverse diameter than that of the relatively wide portions, the anchor member has an internal surface, the narrow portion and immediate adjacent first and second portions of the shaft have an external surface, wherein the internal surface and the external surface each has a profile which is complimentary in shape to each other, wherein a stop portion is mounted about the shaft adjacent the first end thereof.

13. A yielding rock bolt according to claim 12, wherein the stop portion is a welding ring of relatively hard material.

14. A yielding rock bolt arranged to be inserted into a hole in a rock surface, comprising a shaft formed of a solid metal bar, the shaft having a first end and a second end, the shaft having first and second relatively wide portions adjacent the first end and the second end thereof and a relatively narrow portion intermediate the wide portions, an anchor member having a longitudinal bore mounted about the shaft at the relatively narrow portion and adjacent the wide portions, the longitudinal bore having at least a portion of lesser transverse diameter than that of the relatively wide portions, the anchor member has an internal surface, the narrow portion and immediate adjacent first and second portions of the shaft have an external surface, wherein the internal surface and the external surface each has a profile which is complimentary in shape to each other, wherein a mixing paddle is attached to the first end of the shaft.

* * * * *